United States Patent [19]

Silverman et al.

[11] Patent Number: 4,984,913

[45] Date of Patent: Jan. 15, 1991

[54] PRINTER HAVING RIBBON WEAR INDICATOR

[75] Inventors: Stanley Silverman, Westminster; Kenneth A. Konechy, Santa Ana; Ray G. Van De Walker, Tustin; Richard S. Newman, Costa Mesa, all of Calif.

[73] Assignee: Printronix, Inc., Irvine, Calif.

[21] Appl. No.: 217,459

[22] Filed: Jul. 11, 1988

[51] Int. Cl.[5] ..... B41J 35/36

[52] U.S. Cl. ..... 400/249; 400/711; 400/712

[58] Field of Search ..... 400/194, 195, 196, 196.1, 400/202.4, 207, 208, 208.1, 234, 249, 711, 712

[56] References Cited

U.S. PATENT DOCUMENTS

| | | | |
|---|---|---|---|
| 3,941,051 | 3/1976 | Barrus et al. | 101/93.04 |
| 4,091,913 | 5/1978 | Ku et al. | 400/196 X |
| 4,530,612 | 7/1985 | Butera et al. | 400/249 X |
| 4,582,441 | 4/1986 | Carter et al. | 400/712 |
| 4,619,537 | 10/1986 | Do et al. | 400/225 |
| 4,623,902 | 11/1986 | Yamanishi | 400/249 X |
| 4,687,359 | 8/1987 | Barrus et al. | 400/218 |
| 4,705,417 | 11/1987 | Harry | 400/249 X |
| 4,747,716 | 5/1988 | van der Eikel | 400/234 X |
| 4,787,763 | 11/1988 | Kondo | 400/208 X |

FOREIGN PATENT DOCUMENTS

| | | | |
|---|---|---|---|
| 0121971 | 10/1984 | European Pat. Off. | 400/249 |
| 0002790 | 1/1982 | Japan | 400/249 |
| 0103880 | 6/1982 | Japan | 400/249 |
| 0148681 | 9/1982 | Japan | 400/249 |
| 0210881 | 12/1982 | Japan | 400/249 |
| 0049292 | 3/1983 | Japan | 400/202.4 |
| 0059096 | 4/1983 | Japan | 400/249 |
| 0082781 | 5/1983 | Japan | 400/249 |
| 0132580 | 8/1983 | Japan | 400/202.4 |
| 0162370 | 9/1983 | Japan | 400/249 |
| 0215390 | 12/1983 | Japan | 400/249 |
| 0143169 | 6/1986 | Japan | 400/711 |
| 0228976 | 10/1986 | Japan | 400/249 |
| 2184708 | 7/1987 | United Kingdom | 400/208 |

OTHER PUBLICATIONS

IBM Technical Disclosure Bulletin, "Ribbon Usage Indicator", Caudill, vol. 8 No. 8 Jan. 1966, pp. 1137–1138.

IBM Technical Disclosure Bulletin, "Phantom Switch Mode for Printer or Other Apparatus", Zimmerman, vol. 25, No. 4, Sep. 1982, pp. 2191–2192.

*Primary Examiner*—David A. Wiecking
*Assistant Examiner*—Moshe I. Cohen
*Attorney, Agent, or Firm*—George F. Bethel; Patience K. Bethel

[57] ABSTRACT

A dot matrix line printer is disclosed in which the amount of wear of an ink ribbon is measured by continuously compiling data representing impacting action of the printer as the printer prints.

In a first embodiment, this is accomplished by initially determining a dot count based on the length of the ribbon and representing the maximum theoretical useful life of the ink ribbon and then decreasing the initial dot count as printing thereafter commences. The dot count remaining is continuously divided by the initial dot count to determine the percentage of ribbon life remaining. When the dot count has been decreased substantially to zero, a worn ribbon indication is provided to initiate an audible or visible alarm and to prevent further printing until the worn ribbon is replaced. As printing occurs the dots actually printed are counted, and this count is applied to reduce the initial dot count at a rate determined by the type of printing being undertaken. This job rate can be changed as often as desired during use of a ribbon.

In an alternative embodiment the expected ribbon life is translated into a number of dot rows to be printed, and the number is reduced in accordance with the number of dot rows printed as printing thereafter commences. When the dot row number has been reduced substantially to zero, the worn ribbon indication is provided.

16 Claims, 5 Drawing Sheets

PRINTER HAVING RIBBON WEAR INDICATOR

BACKGROUND OF THE INVENTION

1. Field of the Invention

The present invention relates to printers in which a disposable member or substance is worn or depleted as part of the printing process, and more particularly to impact printers of the type in which an ink ribbon impacted against a length of print paper is subject to eventual ink depletion or other forms of wear.

2. History of the Prior Art

Many printers utilize a member or substance which is subject to wear or depletion as a part of the printing process. For example, certain non-impact printers utilize toner as part of the printing process. With use of such printers, the toner is eventually depleted and for this reason must be periodically replaced. Many printers of the impact type utilize a member such as an ink ribbon in the printing process. The ink ribbon is repeatedly impacted against a length of print paper or other printable medium by impact elements. The impact elements may each define the shape of a character in the case of full character printers. Alternatively, the impact elements may simply print dots, with characters or other indicia to be printed being formed in dot matrix fashion.

Dot matrix printers may be of the serial type in which a print head containing a number of print wires, needles or other dot forming elements is reciprocated across the width of the print paper with the print wires being selectively actuated to impact the print paper through a length of ink ribbon to print dots on the paper. Dot matrix printers may also be of the line printer type in which a plurality of hammers or other impact printing mechanisms mounted along the length of a hammerbank or other elongated structure within a shuttle assembly are selectively actuated to impact a print paper through a length of ink ribbon and thereby print dots on the paper as the shuttle assembly is caused to undergo reciprocating motion relative to the paper. An example of such a dot matrix line printer is provided by U.S. Pat. No. 3,941,051, "PRINTER SYSTEM", Barrus et al, which patent issued March 2, 1976, and is commonly assigned with the present application.

Many printers such as the type of dot matrix line printer described in U.S. Pat. No. 3,941,051 of Barrus et al utilize a ribbon drive having an opposite pair of spools disposed adjacent opposite ends of a print station defined by the interface between a platen-supported length of print paper and a reciprocating hammerbank. A length of ink ribbon extends through the print station and has the opposite ends thereof wound upon the opposite pair of spools of the ribbon drive. During printing, the opposite spools of the ribbon drive are rotatably driven to provide generally continuous motion of the length of ink ribbon through the print station. Typically, the ribbon moves through the print station at a speed of 2–8 inches per second. When the end of the ribbon is reached, the direction of drive of the spools is reversed, causing the ribbon to move through the print station in the opposite direction. Depending upon the type of ribbon used, the ribbon may undergo many reversals before experience suggests that the ribbon has become worn and should be replaced.

The rate of ribbon wear in impact printers depends on a number of factors including the type of ribbon being used. Ribbons of the so-called single strike type must be handled in such a manner that subsequent impacting of previously impacted areas thereof is minimized or eliminated. Still other ribbons are made of material which does not allow the ink within the ribbon to freely migrate from one area to another. Consequently, when an area of such a ribbon is impacted, there is little if any migration of ink into the impacted area from adjacent areas to help replace the ink depleted therefrom. Ribbons of this type also require special considerations in determining when they are worn and should be replaced.

Many ribbons used in impact printers are made of fabric or other materials which allow relatively free migration of ink into impacted areas of the ribbon from adjacent areas. Such ribbons tend to maintain the quantity of ink therein relatively uniformly distributed as the ribbon is used. Little regard need be given to variations in print density throughout the area of the ribbon because of the relatively good ink migration which tends to maintain the ink distribution uniform throughout the ribbon. Nevertheless, the ink within the ribbon eventually becomes depleted to such an extent that print quality is impaired. When this happens, the ribbon must be replaced.

The nature of ink migration and the problem of eventual ink depletion have been observed by those in the printer industry for some time. In U.S. Pat. No. 4,687,359 of Barrus et al, "COLOR PRINTER", which patent issued August 18, 1987, and is commonly assigned with the present application, ink migration is discussed in connection with a color printer having a multi-color ink ribbon. As discussed in the patent, the transfer of darker color inks to the lighter color zones can produce unwanted ribbon contamination problems. The patent also discusses printing and ribbon advancement techniques for utilizing different areas of the ribbon to maximize ribbon life.

Ribbon type and ribbon composition are just several of the factors involved in determining useful ribbon life. One of the most important factors is the type of printing being done. Thus, the printing of ordinary text comprised principally of characters tends to result in relatively long ribbon life. Bar code printing, on the other hand, represents one of the heaviest uses of ink ribbons and can reduce the useful life of ribbons to a small fraction of the useful life where the printing is principally text printing. The printing of different types of graphics may involve less ribbon use than in the case of bar codes but more than in the case of text printing. Still other types of printing may result in extremely heavy ribbon usage in certain limited areas of the ribbon while the remainder of the ribbon experiences light usage or none at all. Useful ribbon life has been observed to range from as little as several hours to as much as several months in the case of dot matrix line printers of the type described in previously referred to U.S. Pat. No. 3,941,051 of Barrus et al, depending upon the type of printing being done.

There are further examples in the art of arrangements for determining ribbon wear and of adopting measures for extending useful ribbon life. For example, in U.S. Pat. No. 4,619,537 of Do et al, "RIBBON FEED WITH INK DEPLETION COMPENSATION", issued October 28, 1986, an arrangement is described for periodically monitoring print density within given areas of the ink ribbon. When the density within a particular area is determined to exceed a predetermined threshold, the ribbon is then advanced so that another area thereof is used for printing. However, the technique described in the Do et al patent is of limited value with respect to ribbon wear in general, inasmuch as it is restricted to the periodic monitoring of print density within a particular area of the ribbon. Movement of the serial print head is then used to advance the ribbon where necessary so that separate apparatus for advancing the ribbon need not be provided.

Accordingly, it would be advantageous to provide an arrangement for determining ribbon wear or wear or depletion of a similar member or substance as part of the printing process in which all of the printing activity is compiled on a continuous basis to provide an overall indication of the useful life of the ribbon or similar member or substance which remains. Such an arrangement should be capable of not only providing an indication of when the ribbon should be replaced but of actually stopping the printer until ribbon replacement is accomplished where this feature is desired. It should also be capable of determining the actual ribbon life which can reasonably be expected based on factors such as the length of the ribbon and the job rate or other measure of the type of printing to be done. The techniques in accordance with the invention should be adaptable to different printer arrangements such as those lending themselves to the counting of actual dots or characters to be printed as well as those arrangements which facilitate the counting of dot rows or lines of characters.

BRIEF SUMMARY OF THE INVENTION

Printer systems in accordance with the invention are provided with an arrangement for compiling data representing printing activity on a substantially continuous basis. In general the compilation is carried out without regard to the actual data being printed or the specific areas in which printing occurs, although it is within the scope of the invention to take into account the data being printed and the location of such printing where the situation requires. Basically, the printing activity is continuously recorded such that the volume of printing activity and thus the use of an ink ribbon, toner or other wearable or consumable member or substance is directly measured.

Where ink ribbons having relatively good ink migration are used, a good indication of ink depletion or other ribbon wear is provided simply by continuously compiling data representing the total impacting of the ink ribbon. This may consist of performing a continuous count of the number of dots printed in the case of a dot matrix printer. Alternatively, certain configurations of printer electronics may facilitate the counting of rows of dots being printed rather than the individual dots themselves. Although the number of dots printed in a given row can vary significantly, dot row averages can be utilized based on experience and the type of data being printed so that the counting of dot rows printed provides a reasonably accurate indication of ribbon wear.

In accordance with the invention ribbon life is determined by first determining the maximum theoretical impact action possible, based on ribbon length indicated by the operator, then determining a rate at which a representation of the maximum theoretical impact action should be reduced in response to actual impact action. The rate of reduction is based on current job rate which is a factor determined by the type of printing to be done. An initial count representing the maximum theoretical impact action possible is reduced or decremented by the impact action of the printer as printing progresses, with the decrementing occurring at a rate which is determined by the job rate. The reduced count provides an accurate representation of ribbon wear, and the job rate can be changed at any time without the danger of unacceptable print quality or excessive ribbon waste. In the meantime the reduced count is continuously divided by the initial count to provide to the operator an indication of the percent of ribbon life remaining. When the count has been reduced substantially to zero, a worn ribbon indication is provided. This may be an audible or visible alarm, and the printer may actually be disabled from further printing until the worn ribbon is replaced.

In one example involving a dot matrix line printer, data to be printed is provided by a host interface to a data control unit where text and line formatting is accomplished. A mechanism control unit associated with the data control unit determines the dots that are to be printed in order to print the text and line printing formats stored in the data control unit, and in the process counts the dots to be printed. The output of the mechanism control unit is applied to hammer electronics which controls the actuation of individual hammers mounted along the length of a reciprocating hammerbank to effect printing of the desired dots. The individual hammers impact a length of platensupported print paper through a length of ink ribbon maintained in relatively continuous motion by driving an opposite pair of spools on a ribbon deck to which the opposite ends of the length of ink ribbon are attached.

The dot count performed by the mechanism control unit is provided to a dots printed accumulator in the data control unit which keeps a running total of the dots printed using the ink ribbon. Upon installation of a new ink ribbon a count of the maximum theoretical printed dots possible over the life of the ribbon is determined and stored in a dots remaining accumulator by multiplying an indication of the length of the ribbon by a constant. The count initially entered in the dots remaining accumulator is then decremented by a modification of the count in the dots printed accumulator as the count of printed dots in the mechanism control unit builds up and is periodically transferred into the dots printed accumulator. The modification occurs by multiplying an indication of the job rate by a constant to determine the percentage or fraction represented by the job rate and multiplying such percentage by the count being transferred to arrive at a modified count by which the count in the dots remaining accumulator is decremented. The multiplication process determines the rate of transfer of dot counts from the dots printed accumulator to the dots remaining accumulator as determined by the job rate.

The count stored in the dots remaining accumulator is continually divided by the initial count of the maximum printed dots theoretically possible to provide a continuous indication of the percent of ribbon life remaining. When the count in the dots remaining accumulator is reduced substantially to zero, a worn ribbon alarm is provided, and where desired printing is stopped until the system is reset. Resetting is accomplished by actuating a platen control handle to open the print station of the printer so that the ink ribbon may be replaced, and then pressing a clear fault button on the control panel after the print station has again been closed. Actuation of the platen control handle to open and then close the print station closes an associated switch to satisfy one of the conditions necessary to enter a new initial count into the dots remaining accumulator.

In an alternative embodiment according to the invention, apparatus is provided for counting the number of dot rows being printed. In such arrangement, the ribbon length entered at the control panel by the operator is used to calculate the maximum theoretical count of dot rows that may be printed over the ribbon life, and this initial count is entered in a dot rows remaining accumulator. The dot rows remaining accumulator is then decremented by the count of dot rows printed which is entered in a dot rows printed accumulator. The decrementing occurs at a rate determined by multiplying a job rate indication by a constant. The percent of ribbon life remaining is continuously calculated by dividing the count in the dot rows remaining accumulator by the initial count, and a worn ribbon indication is provided when the count in the dot rows remaining accumulator is reduced substantially to zero.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
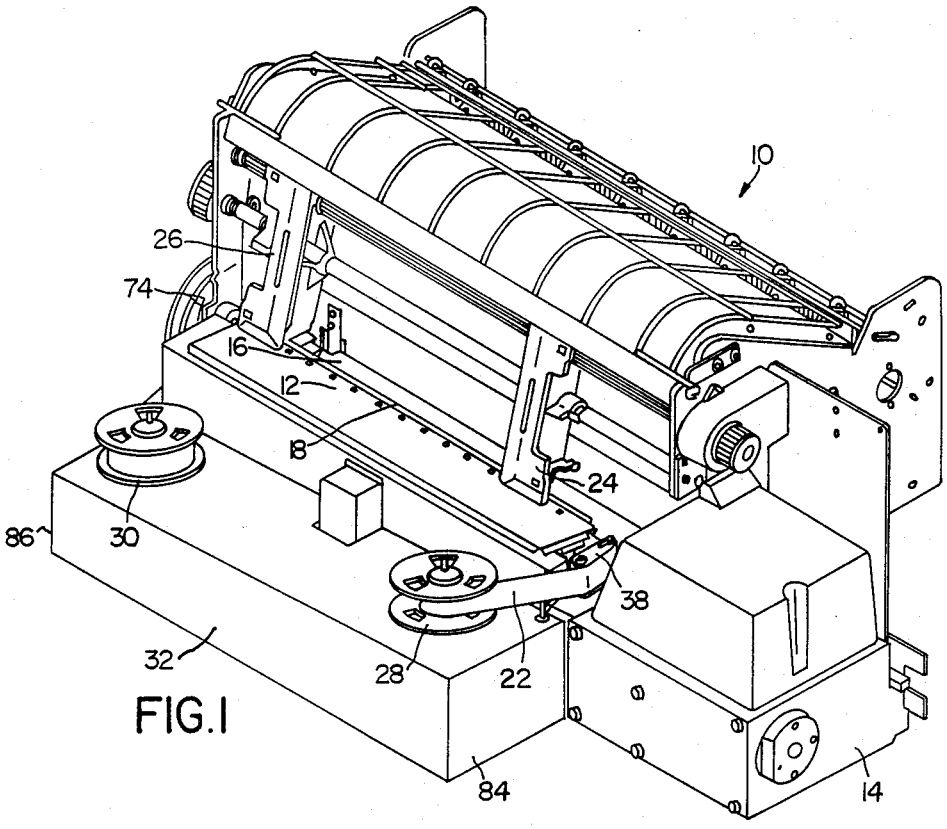
FIG. 1 is a perspective view of a dot matrix line printer having a ribbon wear indicator in accordance with the invention.

FIG. 1 depicts a printer 10 having a ribbon wear indicator in accordance with the invention. The printer 10 which is a dot matrix line printer of the general type shown and described in the previously referred to U.S. Pat. No. 3,941,051 of Barrus et al includes an elongated hammerbank 12 mounted to be driven in reciprocating fashion by a cam-driven shuttle drive 14. The hammerbank 12 reciprocates relative to a stationary platen 16, and the long, narrow space 18 therebetween defines a print station.

Disposed within the print station 18 along the length thereof are a length of print paper 20 (shown only in FIG. 3) and an ink ribbon 22. The print paper 20 is advanced upwardly through the print station 18 by opposite tractor drives 24 and 26 mounted at the opposite sides of an upper portion of the printer 10. The tractor drives 24 and 26 increment the print paper 20 upwardly as each row of dots is printed thereacross, as described hereafter. The ink ribbon 22 extends along the length of the print station 18 and has the opposite ends thereof wound on an opposite pair of spools 28 and 30 within a ribbon drive 32 mounted at the lower front of the printer 10.

Figure 2:
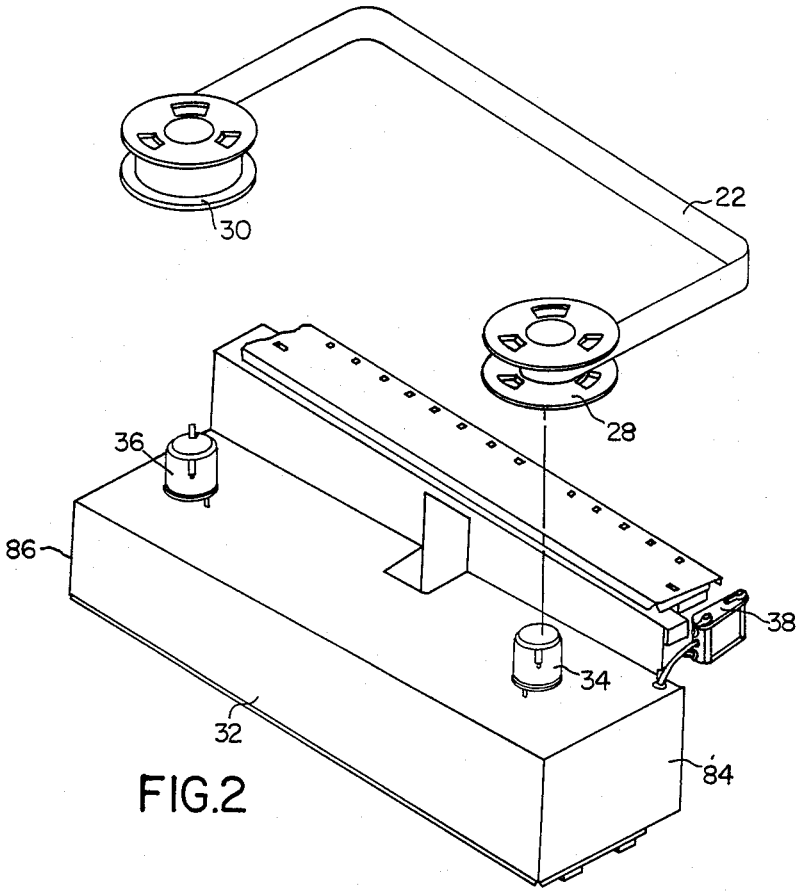
FIG. 2 is a perspective, exploded view of the ribbon drive of the printer of FIG. 1 together with an opposite pair of spools and a length of ink ribbon carried by the spools.

The ribbon drive 32 is shown in enlarged, exploded fashion in FIG. 2. As shown therein the opposite spools 28 and 30 are removably mounted on spindles 34 and 36 rotatably mounted at opposite ends of the ribbon drive 32. The ink ribbon 22 extends from the spool 28 through the print station 18 to the opposite spool 30. Proper disposition of the ribbon 22 within the print station 18 is facilitated by a pair of guides mounted at opposite ends of the print station 18. One such guide 38 is shown in FIG. 2.

When the printer 10 is printing, motors (not shown) mounted inside of the ribbon drive 32 rotatably drive the spindles 34 and 36 and thus the spools 28 and 30 mounted thereon so that the ink ribbon 22 undergoes generally continuous movement through the print station 18. The speed of the ink ribbon 22 may vary depending upon various factors including the printing conditions, but typically the speed is within a range of 2–8 inches per second (ips). Normally, the ink ribbon 22 is advanced in a first direction such as from the spool 28 to the spool 30 until the end of the ribbon 22 is reached. At that point, the direction of drive is reversed so that the ribbon 22 is advanced in an opposite second direction from the spool 30 to the spool 28 until the end of the ribbon 22 is reached. The ribbon 22 typically undergoes several such reversals before it is determined that the ribbon 22 is worn and should be replaced.

Figure 3:
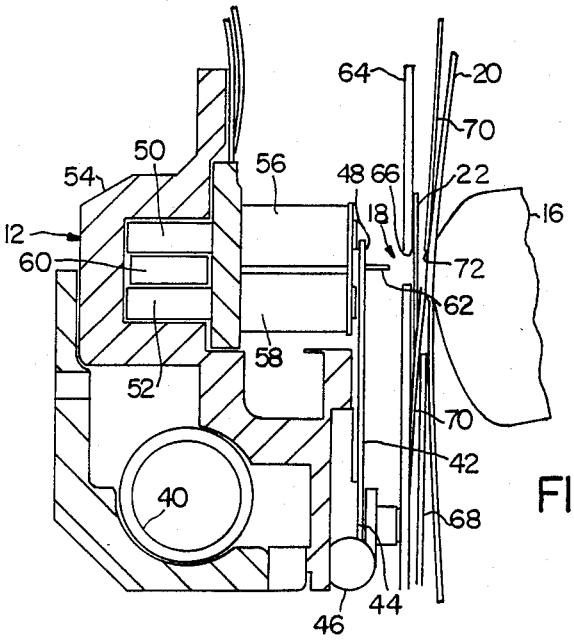
FIG. 3 is a sectional view of a portion of the printer of FIG. 1 illustrating the manner in which impact printing is carried out using a reciprocating hammerbank in conjunction with the length of ink ribbon of FIG. 2 and a platen-supported length of print paper.

The nature of the print station 18 formed by the interface between the hammerbank 12 and the platen 16 is better shown in the sectional view of FIG. 3. The hammerbank 12 includes a shuttle shaft 40 extending from the opposite ends to mount the hammerbank 12 for reciprocating motion. A plurality of resiliently flexible hammer springs 42 are mounted along the length of the hammerbank 12 such that a lower end 44 of each spring 42 is secured to a base 46 of the hammerbank 12. An opposite upper end 48 of each hammer spring 42 which is free to move with flexure of the spring 42 is normally held in a retracted position against a pair of pole pieces 50 and 52 mounted within a frame 54 of the hammerbank 12 and having a pair of coils 56 and 58 mounted thereon. A permanent magnet 60 is disposed between the pole pieces 50 and 52 within the frame 54.

The upper end 48 of the hammer spring 42 is normally held in the retracted position against the pole pieces 50 and 52 by the action of the permanent magnet 60 which forms a magnetic circuit with the pole pieces 50 and 52 and the upper end 48 of the hammer spring 42. The hammer spring 42 is held in the retracted position until released or "fired" by momentarily energizing the coils 56 and 58. During reciprocating movement of the hammerbank 12 relative to the platen 16 and the length of print paper 20, dots are printed in selected locations within a dot row extending across the width of the paper 20 by momentarily energizing the coils 56 and 58 of those hammer springs 42 which are to be fired. The momentary energizing of the coils 56 and 58 overcomes the magnetic force of the permanent magnet 60, causing the spring 42 to fly away from the pole pieces 50 and 52. A dot printing impact tip 62 mounted at the upper end 48 of the hammer spring 42 impacts the ink ribbon 22 against the platen supported print paper 20 to print a dot on the paper 20, following which the spring 42 rebounds into the retracted position against the pole pieces 50 and 52. The hammer spring 42 remains in the retracted position until the next firing thereof by momentary energizing of the coils 56 and 58.

A thin planar hammerbank cover 64 mounted at the base 46 of the hammerbank 12 along the length thereof and which is spaced by a small distance from the platen 16 has a plurality of apertures 66 therein spaced along the length thereof. Each of the apertures 66 is disposed adjacent a different one of the dot printing impact tips 62, allowing the tip 62 to extend therethrough for impacting of the ink ribbon 22 against ,the platen supported paper 20. A thin planar paper ironer 68 of resilient material disposed between the paper 20 and the hammerbank cover 64 below the dot printing impact tips 62 and the apertures 66 resiliently bears against the paper 20 to create a drag and thereby hold the paper 20 under tension as the paper 20 is advanced upwardly by the opposite tractor drives 24 and 26. A ribbon mask 70 disposed between the paper 20 and the hammerbank cover 64 above the dot printing impact tips 62 and between the paper ironer 68 and the hammerbank cover 64 below the dot printing impact tips 62 serves as a guide for the ink ribbon 22 and prevents direct contact between the ink ribbon 22 and the paper 20 except through apertures 72 through which the dot printing impact tips 62 may impact the ink ribbon 22 against the paper 20.

The platen 16 is coupled to a platen control handle 74 which is shown in FIG. 1 and which can be used to vary the size of the gap between the platen 16 and the dot printing impact tips 62 of the hammerbank 12 within the print station 18. Actuation of the platen control handle 74 by movement into an extreme position moves the platen 16 away from the dot printing impact tips 62 by a substantial distance so as to open the print station 18 to permit loading of the paper 20 and replacement of the ink ribbon 22. The platen control handle 74 may then be returned so as to close the print station 18 to a paper gap size in preparation for commencement of printing.

Figure 4:
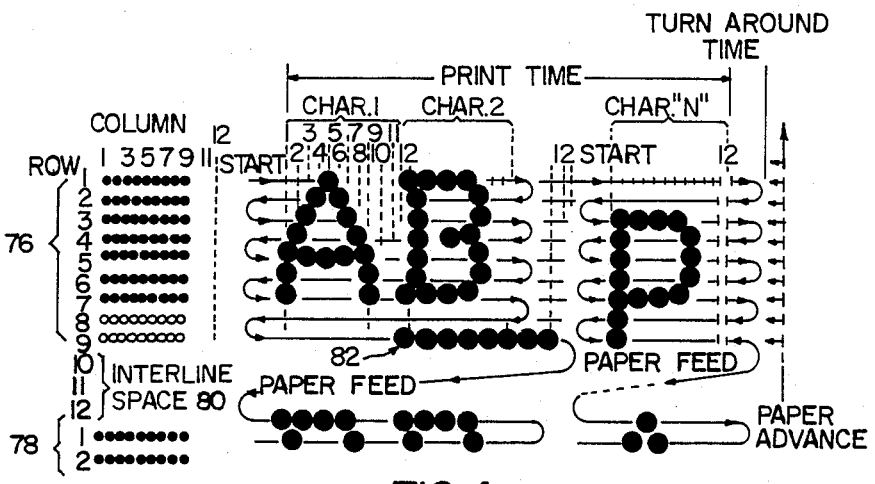
FIG. 4 is a graphical representation of the manner in which character printing is accomplished using the printer of FIG. 1.

FIG. 4 illustrates the manner in which certain print data such as characters are printed in dot matrix fashion using the printer 10. In the example of FIG. 4 each print line across the width of the paper 20 is comprised of nine dot rows, followed by three rows of interline space before the next print line begins. One such print line 76 is shown in FIG. 4 together with the top two dot rows of a following print line 78. An interline space 80 formed by three dot rows following the print line 76 is also shown. Each of the print lines such as the print line 76 is comprised of a succession of character spaces which are designated in FIG. 4 as CHAR. 1, CHAR. 2, and eventually CHAR "N". Each such character space is comprised of eleven dot columns, the first nine of which are used to print the character within the space and the last two of which are used to provide a space immediately following the character.

In the present example, the hammerbank 12 has sixty-six of the hammer springs 42 mounted along the length thereof so as to be spaced across the width of the paper 20. Each print line, such as the print lines 76 and 78 across the paper 20, is comprised of a succession of 132 character spaces. Accordingly, each hammer spring 42 covers two of the character spaces in each line and may be used to print two characters in each line. Thus, CHAR. 1 and CHAR. 2 shown in FIG. 4 are printed by a single one of the hammer springs 42, while CHAR "N"and an adjacent character are printed by a different one of the hammer springs 42.

During a first sweep of the hammerbank 12 across the paper 12 within the print line 76, the first dot row of the print line 76 is printed. During such sweep, the hammer spring 42 used to print CHAR. 1 and CHAR. 2 prints the single dot at the top of the "A" comprising CHAR. 1 and the four dots comprising the top line of the "B" of CHAR 2. Because the "p" to be printed as CHAR. "N" is lower case, no dots are printed in the first row.

Dot printing may occur during the "PRINT TIME" shown in FIG. 4 as the hammerbank 12 undergoes its reciprocating movement across the paper 20. The PRINT TIME is followed by "TURNAROUND TIME" at the opposite ends of the reciprocating movement. During TURNAROUND TIME, dot printing does not occur. Instead, the direction of the hammerbank 12 is reversed, and at the same time the tractor drives 24 and 26 are used to advance the paper 20 to the next dot row position. The hammerbank 12 then sweeps across the paper 20 in the opposite direction to effect printing of the next dot row.

During the third dot row of the print line 76, two dots of the "A" in CHAR. 1 and two dots of the "B" in CHAR. 2 are printed by the associated hammer spring 42. The hammer spring 42 used to print the "p" in CHAR. "N" prints the four dots comprising the top line of the "p".

Printing continues in this fashion until all of the dot rows of the print line 76 are printed. Capital letters such as the "A" and "B" comprising CHAR. 1 and CHAR. 2 are completely printed within the first seven dot rows. As just noted, the top line of the lower case "p" does not occur until the third dot row. At the same time, the "p"has a "descender" , meaning that the vertical leg of the "p"extends downwardly into and is printed as part of dot rows eight and nine. Also in the example of FIG. 4, the "B" comprising CHAR. 2 is to be underlined, and the underlining 82 is printed in the ninth dot row.

After the ninth dot row of the print line 76 is printed, the tractor drives 24 and 26 advance the paper 20 through the tenth, eleventh and twelfth dot rows during the following sweep of the hammerbank 12 across the paper 20, in preparation for printing of the next print line 78. The print line 78 is then printed in similar fashion, as are the succeeding print lines.

It will be seen from FIG. 1 and especially from FIG. 2 that the ribbon drive 32 has a right end 84 thereof which is slightly elevated relative to an opposite left end 6 thereof. This disposes the spindle 34 at a location slightly higher than the spindle 36 so that the ribbon 22 slopes slightly as it extends across the print station 18. The ribbon 22 is wider than each of the print lines such as the print line 76 so that the ribbon 22 encompasses the entire height of a print line even though it is sloped or skewed across the length of the print station 18. This skewed positioning of the ribbon 22 within the print station 18 helps to distribute the impacting of the ribbon 22 across its width as the ribbon 22 continuously moves through the print station 18 and the various dot rows are printed by the hammer springs 42 along the length of the hammerbank 12.

The configuration and operation of the printer 10 as thus far described in connection with FIGS. 1–4 is conventional. Further details are generally shown and described in the previously referred to U.S. Pat. No.

3,941,051 of Barrus et al which is incorporated herein by reference. In addition, a more specific example of the particular printer thus far described can be found in two different copending applications which are commonly assigned with the present application and which are incorporated herein by reference. The two copending applications include U.S Ser. No. 069,486 of Farb et al, filed July 1, 1987, entitled "PRINTER HAVING INTERCHANGEABLE SHUTTLE ASSEMBLY", and now abandoned and U.S. Ser. No. 069,021 of Farb et al, filed July 1, 1987, entitled "PRINTER HAVING IMPROVED HAMMERBANK" and now abandoned in favor of U.S. Ser. No. 250,397, filed Sep. 28, 1988.

Figure 5:
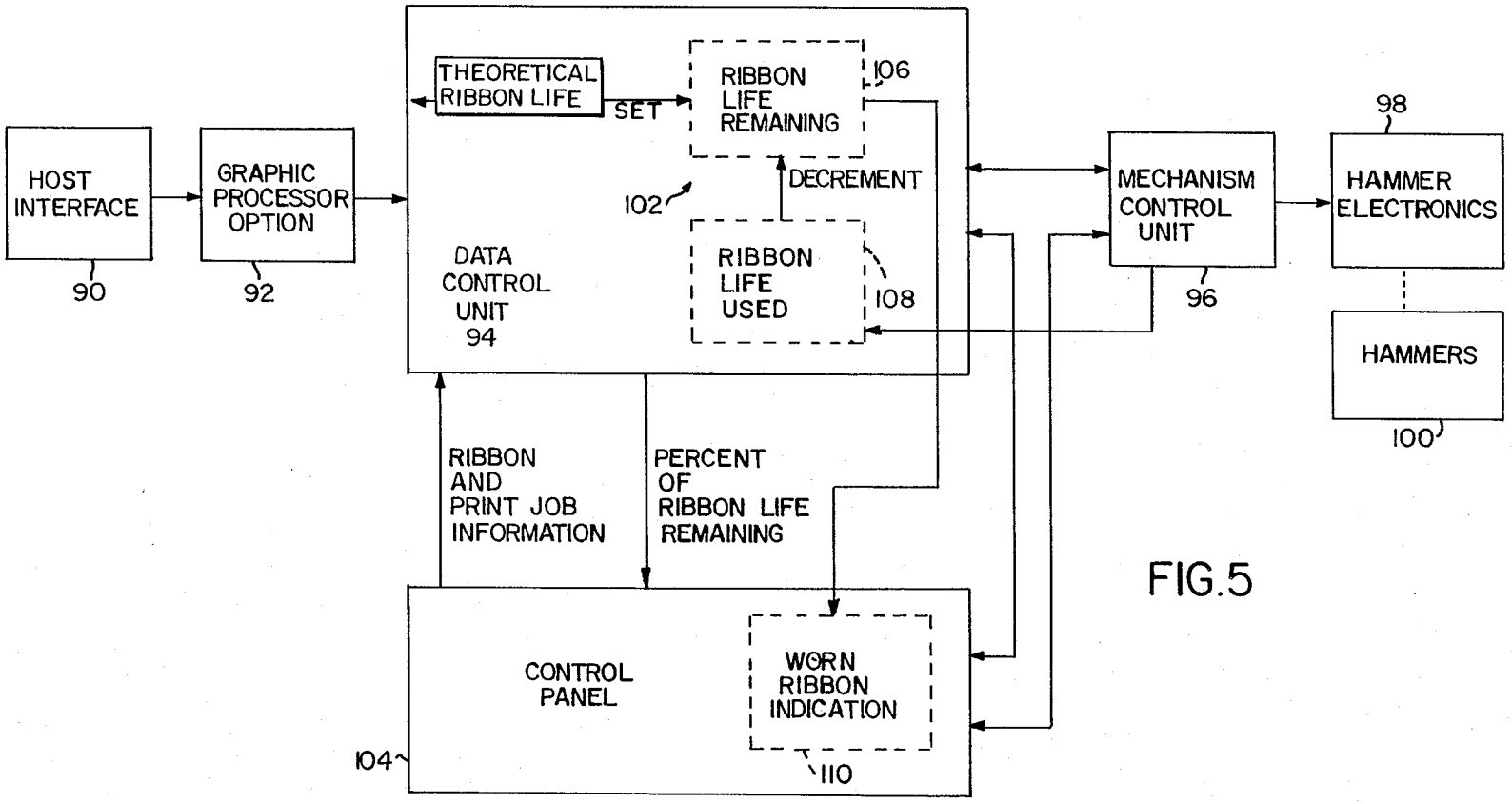
FIG. 5 is a basic block diagram of the electronic control circuitry for the printer of FIG. 1 including the ribbon wear indicator.

The electronic control circuitry for the printer 10 which includes a ribbon wear indicator in accordance with the invention is shown in basic block diagram form in FIG. 5. The printer 10 interfaces with external sources of print information within the overall printer system through a host interface 90. Data to be printed which is received by the host interface 90 is passed via a graphic processor option 92 to a data control unit 94. The graphic processor option 92 is employed in those instances where the data to be printed comprises graphics requiring special handling.

The data to be printed which may or may not be modified by the graphic processor option 92 is applied to the data control unit 94 and then to a mechanism control unit 96. The data control unit 94 performs text and line formatting of the data to be printed, while the mechanism control unit 96 translates the formatted data from the data control unit 94 into individual dots to be printed. Signals representing dots to be printed are provided by the mechanism control unit 96 to hammer electronics 98 which are operative to actuate or "fire" a plurality of hammers 100 to effect printing of the dots. The hammers 100 correspond to the hammer springs 42 shown in FIG. 3, while the hammer electronics 98 include the magnetic hammer actuators of the hammerbank 12. The magnetic hammer actuators include the pole pieces 50 and 52, the coils 56 and 58, and the permanent magnet 60.

The electronic control circuitry of FIG. 5 as described thus far is of conventional design and function. In accordance with the invention, however, such electronic control circuitry is provided with a ribbon wear indicator 102. In the example of FIG. 5, the ribbon wear indicator 102 comprises portions of the data control unit 94, the mechanism control unit 96 and a control panel 104 for the printer 10. As described in greater detail hereafter in connection with FIG. 6, the control panel 104 enables the printer operator to enter information on the length of the ink ribbon 22 and the print job to be undertaken. The data control unit 94 receives and uses this information to determine the actual ribbon life which can be expected.

The present examples assume that the ink ribbon 22 is of the type providing relatively free ink migration. Thus, when a dot, character or other indicia is impacted against the ribbon 22 ink from adjacent areas of the ribbon 22 migrates to the impacted area to replenish the ink. Consequently, the ink within the ribbon 22 tends to be relatively uniformly distributed as it is gradually depleted. The ink supply does not remain completely uniform in the sense that heavy and repeated use of certain areas of the ribbon 22 will tend to deplete the ink faster in those areas compared to areas that experience relatively little or no use. Nevertheless the counting of impacting activity such as the number of dots printed or the number of dot rows printed provides a reliable if generalized indication of the amount of wear to which the ribbon 22 is being subjected.

In the arrangement of FIG. 5, the theoretical ribbon life is expressed in terms of a quantity of ribbon impacting action and is applied to the "set" input of a circuit 106 within the data control unit 94. The circuit 106 stores a value that represents ribbon life remaining. As printing by the printer 10 proceeds, the mechanism control unit 96 compiles information representing impacting action and transfers this information periodically to a circuit 108 in the data control unit 94. The information representing impacting action which is entered in the circuit 108 is applied to decrement the value stored in the ribbon life remaining circuit 106 at a rate determined by the job rate for the type of printing being done. In this manner the value stored in the ribbon life remaining circuit 106 continues to provide an accurate representation of the amount of wear of the ribbon 22.

By periodically dividing the value in the circuit 106 by the initial value applied to the set input of the circuit 106, a determination is made of the percent of ribbon life remaining. This information is provided to the control panel 104 for display to the operator.

When the value in the circuit 106 has been reduced substantially to zero, an indication is provided to a circuit 110 within the control panel that the ribbon 22 is worn and should be replaced. The circuit 110 may provide an audible or visual alarm to the operator. The circuit 110 may also disable the printer 10 from further printing until the ribbon 22 is replaced and the operator signals that a new initial value may be entered in the circuit 106.

Figure 6:
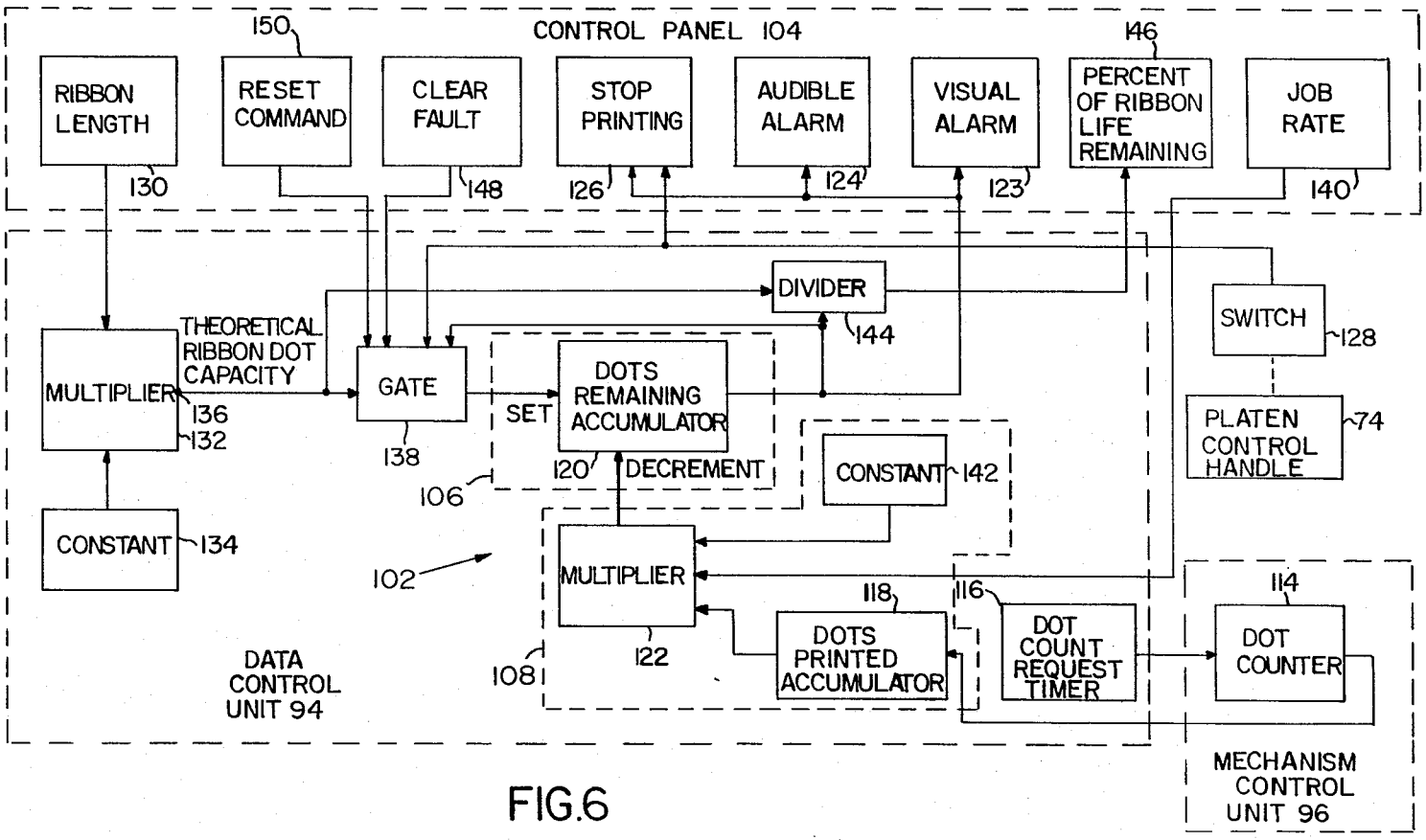
FIG. 6 is a more detailed block diagram of a portion of the electronic control circuitry of FIG. 5 in an arrangement in which printed dots are counted to determine wear of the ink ribbon.

FIG. 6 provides a detailed example of the ribbon wear indicator 102 of FIG. 5. The mechanism control unit 96 which is comprised of a processor such as a Zilog Z8 processor is organized so as to include a dot counter 114. The dot counter 114 counts dots as they are provided to the hammer electronics 98 for printing, and therefore provides a count of the dots being printed by the hammers 100. The data control unit 94 which is comprised of a processor such a Motorola or Mostek 68000 includes a dot count request timer 116. The dot count request timer 116 periodically interrogates the dot counter 114 within the mechanism control unit 96, causing the dot count therein to be unloaded into a dots printed accumulator 118 within the data control unit 94.

The dots printed accumulator 118 comprises part of the ribbon life used circuit 108 of FIG. 5, and a dots remaining accumulator 120 comprises the ribbon life remaining circuit 106 of FIG. 5. Upon installation of a new ribbon 22 in the printer 10, a count representing the maximum theoretical number of dots capable of being printed by the ribbon 22 before the ribbon >is worn out is determined and applied to the "set" input of the dots remaining accumulator 120. As printing proceeds, this initial count within the dots remaining accumulator 120 is decremented by the dot counts periodically transferred to the dots printed accumulator 118 from the dot counter 114 at a rate determined by a multiplier 122. When the count within the dots remaining accumulator 120 has been reduced substantially to zero, a worn ribbon indication is provided to a visual alarm 123, an audible alarm 124 and a stop printing circuit 126 within the control panel 104. The visual alarm 123 provides a visual alarm signal to the operator at the control panel 104. The audible alarm 124 provides an audible alarm to the operator at the control panel 104. The stop printing circuit 126 acts to prevent further printing until the ribbon 22 is replaced. Typically, the printer 10 is not stopped immediately by the circuit 126 but is allowed to print through the remainder of the page being printed or in some cases the next page thereafter.

As noted the stop printing circuit 126 responds to a worn ribbon indication from the dots remaining accumulator 120 to prevent the printer 10 from further printing until the ribbon 22 is replaced. As previously described in connection with FIGS. 1–3, replacement of the ink ribbon 22 of the printer 10 requires that the platen control handle 74 be moved into a position which opens up the print station 18. Actuation of the platen control handle 74 to open and then close the print station 18 as the ribbon 22 is replaced results in closure of a switch 128 which satisfies one of the conditions necessary to reset the dots remaining accumulator 120.

The initial count applied to the set input of the dots remaining accumulator 120 represents the maximum theoretical number of dots capable of being printed by a new ribbon 22. Such initial count is determined in accordance with the length of the ribbon 22. The control panel 104 includes a ribbon length indicator 130 into which the operator enters the ribbon length. This value is multiplied within a multiplier 132 by a constant 134 to provide at an output 136 of the multiplier 132 a value representing the theoretical number of dots which can be printed using the ribbon 22. The constant 134 is determined in advance in accordance with the known dot printing capacities of ink ribbons 22 of different length. The greater the length of the ink ribbon 22 the greater is the number of dots theoretically capable of being printed by the ribbon 22. The theoretical count value determined by the multiplier 132 at the output 136 thereof is applied to the set input of the dots remaining accumulator 120 for storage therein under the control of a gate 138.

The control panel 104 includes a job rate indicator 140 in which the operator enters a job rate number based upon the type of printing to be carried out by the printer 10. The job rate takes into account the fact that certain types of high volume printing such as graphics printing and particularly bar code printing involve relatively rapid ink depletion over substantial areas of the ribbon 22 with little chance for ink migration to restore ink uniformity. The job rate also takes into account the fact that certain printing jobs result in heavy usage of particular areas or stripes on the ribbon 22 even though the remainder of the ribbon 22 may undergo little or no use at all, and in this respect the job rate is valuable in determining actual ribbon wear and need for replacement even though the average overall usage of the ribbon 22 is relatively light. Still other factors enter into the job rate, including average line length. Thus, if the printing to be undertaken involves but a few letters or words at the left hand margin of most or all lines, most of the impacting will occur in the upper regions of the ribbon 22 as opposed to the central and lower regions thereof because of the skewed disposition of the ribbon 22 within the print station. Experience factors such as these enter into the selection of the job rate for the printing job to be done. In the present example the job rate as provided by the circuit 140 at the control panel 104 is expressed as a number between 001 and 999. At the lower extreme, a job rate of 001 represents very light printing. At the other extreme a job rate of 999 represents extremely heavy duty printing approaching the requirements of an all black page.

Having entered the job rate into the job rate indicator 140, the multiplier 122 converts the job rate number into a percentage or fraction by multiplying by a constant 142. The multiplier 122 also determines the rate at which the count initially stored in the dots remaining accumulator 120 is to be decremented by the count stored in the dots printed accumulator 118, and does so by multiplying the counts periodically stored in the dots printed accumulator 118 by the percentage or fraction representing the job rate and applying the resulting product to decrement the count in the dots remaining accumulator 120.

It will be seen that the initial count determined by the multiplier 132 and entered in the dots remaining accumulator 120 represents the maximum theoretical number of dots which a ribbon 22 of given length can print. This number is then reduced by the amount of actual impacting action which occurs as printing takes place and which therefore represents actual usage of the ribbon 22. The counts stored in the dots printed accumulator 118 are directly related to impact action as determined by the dot counter 114, and these are modified by the multiplier 122 in order to present to the dots remaining accumulator 120 a representation of actual ribbon usage but modified in accordance with the type of printing being done as represented by the job rate.

The count stored in the dots remaining accumulator 120 represents, at any given instant, the actual amount of wear which the ribbon 22 has undergone. Such count also represents the theoretical maximum or worst case of dots remaining in the ribbon 22 and not the actual dots remaining based on job rate. Because the count representing the theoretical maximum of dots remaining is always correct, the job rate can be changed at any time without introducing a linear distortion in the amount of ribbon wear already measured. The multiplier 122 performs a scaling multiplication from actual dots printed to theoretical dots printed. A change in the job rate changes the rate at which the theoretical capacity of the ribbon 22 is depleted.

It is therefore possible to change the type of printing being done and thus the job rate one or more times during use of a particular ribbon 22 while continuing with an accurate determination of the amount of wear of that ribbon 22. Each time the job rate is changed, the ribbon wear indicator 102 simply changes the wear factor as printing thereafter proceeds by changing the multiplication factor in the multiplier 122.

The ability to change the job rate one or more times during the use of a particular ribbon 22 prevents the ribbon wastage that might otherwise result if the ribbon 22 had to be discarded as a precaution each time the print job changed. It also prevents a reduction in print quality that might otherwise result from retention of a ribbon 22 in the face of a change in type of printing and without the ability to determine the different rate of ribbon wear.

As described thus far the job rate is entered in the job rate indicator 140 in the control panel 104 by the operator. From there, the job rate is provided to the multiplier 122. Alternatively, however, the job rate (and for that matter the representation of ribbon length) can be loaded directly from a host computer via the host interface 90.

As printing proceeds and the count within the dots remaining accumulator 120 is decreased, the decreased count is continually divided within a divider 144 by the initial count provided by the multiplier 132. The quotient is the percent of ribbon life remaining, and this value is provided by the divider 144 to a percent of ribbon life remaining indicator 146 within the control panel 104. The percent of ribbon life remaining indicator 146 provides a visible display to the operator in the form of a number representing the percent of ribbon life remaining.

As previously noted the reduction of the count stored in the dots remaining accumulator 120 substantially to zero results in an indication that the ribbon 22 is worn and should be replaced. This may include actuation of the visual alarm 123, the audible alarm 124, the stop printing circuit 126, or any desired combination thereof. It also satisfies one of the inputs of the gate 138 which is operative to pass the theoretical ribbon dot capacity count at the output 136 of the multiplier 132 to the dots remaining accumulator 120 only if two other inputs are satisfied. The two other inputs, are coupled to the switch 128 and to a clear fault button 148 in the control panel 104. As previously described operation of the platen control handle 74 to open and then close the print station 18 during replacement of the ribbon 22 closes the associated switch 128 to satisfy the associated input to the gate 138. When the operator then presses the clear fault button 148, the third input of the gate 138 is satisfied, and the output 136 of the multiplier 132 is coupled to load the count thereof into the dots remaining accumulator 120.

Occasionally a condition will occur during printing which dictates that the ribbon 22 be replaced even though it is not worn as determined by a count of substantially zero in the dots remaining accumulator 120. This may occur, for example, when the ribbon 22 tears. When this occurs the gate 138 may be opened to reset the dots remaining accumulator 120 in accordance with the count at the output 136 of the multiplier 132 by a reset command 150 within the control panel 104. The reset command 150 is provided by the operator.

The example of FIG. 6 is based on a printer 10 having a mechanism control unit 96 which includes the dot counter 114. Counting dots provides a direct and accurate representation of the impacting activity undergone by the ink ribbon 22. However, other implementations are possible in accordance with the invention. Thus, it will be appreciated by those skilled in the art that the principles of the invention can be used to monitor the impacting activity of other types of impact printers such as serial matrix printers and full character printers. Similar considerations apply to nonimpact printers such as those in which toner usage is to be monitored in order to provide an indication of when the toner must be replaced.

Figure 7:
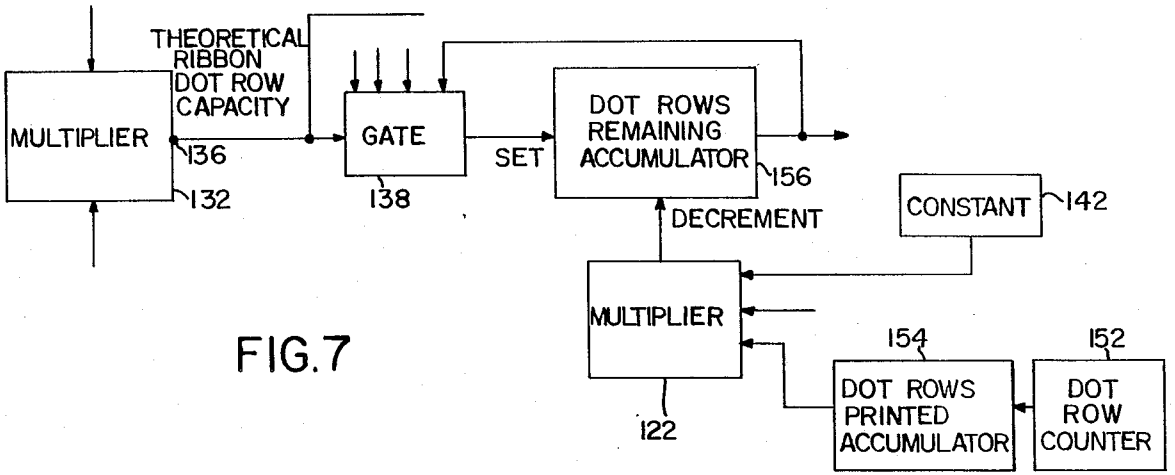
FIG. 7 is a more detailed block diagram of a small portion of the electronic control circuitry of FIG. 5 in an arrangement in which printed dot rows are counted to determine wear of the ink ribbon.

In certain dot matrix line printers having the basic electronic control circuitry configuration shown in FIG. 5, the data control unit 94 and the mechanism control unit 96 include a provision for counting dot rows printed rather than dots printed. The principles of the invention are equally applicable to such printers, as shown in FIG. 7. In the example of FIG. 7 a single processor combining the functions of the data control unit 94 and the mechanism control unit 96 includes a dot row counter 152 which counts dot rows to be printed as the dots are passed to the hammer electronics 98 for printing by the hammers 100. The dot row count from the counter 152 is periodically passed to a dot rows printed accumulator 154 which corresponds to the dots printed accumulator 118 in the arrangement of FIG. 6 and which proceeds to count the dot rows as determined by the counter 152 as printing proceeds. This count is applied by the multiplier 122 to decrement the count within a dot rows remaining accumulator 156, the output of which is coupled to the visual alarm 123, the audible alarm 124 and the stop printing circuit 126 within the control panel 104 and to the divider 144 shown in FIG. 6.

A maximum theoretical count which is initially applied to the "set" input of the dot rows remaining accumulator 156 in FIG. 7 is determined by the multiplier 132 which functions in the same manner as in the example of FIG. 6. As in the example of FIG. 6 the ribbon length entered in the indicator 130 is multiplied within the multiplier 132 by the constant 134.

In the example of FIG. 7 the job rate provided by the job rate circuit 140 is modified as necessary to accommodate the fact that dot rows rather than dots are being counted. The multiplier 122 determines the rate at which the dot row counts in the dot rows printed accumulator 154 are applied to decrement the count in the dot rows remaining accumulator 156 by multiplying the dot row count by the job rate and the constant 142.

In the case of many types of printing including ordinary text printing involving characters, the length of a print line can vary from as little as a single character or symbol adjacent the left hand margin to the other extreme in which a full line of characters is printed across the entire width of the printable portion of the page. The job rate circuit 140 stores a job rate number that takes this into account. The multiplier 122 multiplies the job rate number by the constant 142 to determine the rate at which the count of dots rows printed in the accumulator 154 decrements the count in the dot rows remaining accumulator 156. The constant 142 is derived by dividing the number of dots per dot row by the largest possible job rate.

It will be appreciated that variations of the specific embodiments disclosed are possible in accordance with the invention. For example the impact area across the platen 16 can be divided into discrete horizontal regions with corresponding areas of the ribbon 22 being separately monitored to provide more accurate information on ribbon wear.

While the invention has been particularly shown and described with reference to preferred embodiments thereof, it will be understood by those skilled in the art that various changes in form and details may be made therein without departing from the spirit and scope of the invention.

What is claimed is:

1. A method of determining when an ink ribbon in an impact printer system should be replaced, comprising the steps of:

determining a theoretical amount of impacting of the ink ribbon possible based on the length of the ink ribbon;

decreasing the theoretical amount in accordance with the amount of impacting of the ink ribbon as the printer system prints; and signaling that the ribbon should be replaced when the theoretical amount has been decreased substantially to zero;

the step of determining a theoretical amount comprising providing a ribbon length indication and multiplying the ribbon length indication by a constant.

2. A method of determining when an ink ribbon in an impact printer system should be replaced, comprising the steps of:

determining a theoretical amount of impacting of the ink ribbon possible based on the length of the ink ribbon;

decreasing the theoretical amount in accordance with the amount of impacting of the ink ribbon as the printer system prints; and signaling that the ribbon should be replaced when the theoretical amount has been decreased substantially to zero;

the step of decreasing the theoretical amount comprising decreasing the theoretical amount by the product of the amount of impacting of the ink ribbon as the printer system prints and a job rate factor representing the nature of printing being done.

3. A method of determining when an ink ribbon in an impact printer system should be replaced, comprising the steps of:

determining a theoretical amount of impacting of the ink ribbon possible based on the length of the ink ribbon;

decreasing the theoretical amount in accordance with the amount of impacting of the ink ribbon as the printer system prints; and signaling that the ribbon should be replaced when the theoretical amount has been decreased substantially to zero;

the step of signaling that the ribbon should be replaced including stopping the printer system and thereafter allowing printing to continue only after the ink ribbon has been replaced.

4. A method of determining when an ink ribbon in an impact printer system should be replaced, comprising the steps of:

determining a theoretical amount of impacting of the ink ribbon possible based on the length of the ink ribbon;

decreasing the theoretical amount in accordance with the amount of impacting of the ink ribbon as the printer system prints;

signaling that the ribbon should be replaced when the theoretical amount has been decreased substantially to zero; and continously providing an indication of ribbon life remaining by dividing the decreased theoretical amount by the theoretical amount initially determined.

5. In an impact printer system having an ink ribbon which is gradually worn as printing occurs, an arrangement for indicating the percent of ribbon life remaining comprising:

means for providing a first value representing a quantity of impacting activity which the ink ribbon can be expected to undergo over its life;

means for decreasing the first value in accordance with the impacting activity engaged in by the printer system to provide a second value representing the ribbon life remaining; and means for dividing the second value by the first value to provide an indication of the percent of ribbon life remaining.

6. The invention set forth in claim 5, wherein the arrangement includes an accumulator coupled to be initially set at a set input thereof by the first value, a decrement input coupled to receive a representation of impacting activity engaged in by the printer system, and an output, the accumulator storing the second value therein and providing the second value at the output, and a divider having inputs coupled to the set input and the output of the accumulator.

7. In an impact printer system having an ink ribbon which is gradually worn as printing occurs, an arrangement for indicating when the expected life of the ribbon is ended comprising:

means for providing a count representing maximum theoretical printer system impact action possible for the ink ribbon;

an accumulator having a set input coupled to be initially set by the count representing maximum theoretical printer system impact action possible, and a decrement input coupled to decrement the count initially set therein in response to impact action undergone by the printer system, the decremented count within the accumulator being provided at an output thereof; and means coupled to the output of the accumulator for providing an indication that the ink ribbon is worn when the count in the accumulator has been decremented substantially to zero;

the means for providing an indication that the ink ribbon is worn comprising means for preventing further printing by the printer system until the ink ribbon is replaced.

8. In an impact printer system having an ink ribbon which is gradually worn as printing occurs, an arrangement for indicating when the expected life of the ribbon is ended comprising:

means for providing a count representing maximum theoretical printer system impact action possible for the ink ribbon;

an accumulator having a set input coupled to be initially set by the count representing maximum theoretical printer system impact action possible, and a decrement input coupled to decrement the count initially set therein in response to impact action undergone by the printer system, the decremented count within the accumulator being provided at an output thereof;

means coupled to the output of the accumulator for providing an indication that the ink ribbon is worn when the count in the accumulator has been decremented substantially to zero; and a scaling circuit and a second accumulator coupled to the decrement input of the first mentioned accumulator through the scaling circuit and having an input coupled to receive signals in response to impact action undergone by the printer system.

9. The invention set forth in claim 8, wherein the printer system has a platen control handle which is actuated to replace the ink ribbon and a switch coupled to permit resetting of the first accumulator whenever the platen control handle is actuated.

10. The invention set forth in claim 8, further including a dot counter coupled to count dots printed by the printer system and coupled to the input of the second accumulator, and means for periodically unloading the dot counter into the second accumulator.

11. The invention set forth in claim 8, further including a dot row counter coupled to count dot rows printed by the printer system and coupled to provide the count therein to the input of the second accumulator.

12. In an impact printer system having an ink ribbon which is gradually worn as printing occurs, an arrangement for indicating when the expected life of the ribbon is ended comprising:

means for providing a count representing maximum theoretical printer system impact action possible for the ink ribbon;

an accumulator having a set input coupled to be initially set by the count representing maximum theoretical printer system impact action possible, and a decrement input coupled to decrement the count initially set therein in response to impact action undergone by the printer system, the decremented count within the accumulator being provided at an output thereof; and means coupled to the output of the accumulator for providing an indication that the ink ribbon is worn when the count in the accumulator has been decremented substantially to zero;

the means for providing a count representing maximum theoretical printer system impact action possible for the ink ribbon including means for providing an indication of ribbon length, means for providing a first constant, and a first multiplier for multiplying the indication of ribbon length by the constant to provide the count representing maximum theoretical printer system impact action possible for the ink ribbon;

means for providing an indication of job rate for printing to be done by the printer system;

means for providing a second constant;

a second multiplier; and a second accumulator coupled to the decrement input of the first mentioned accumulator through the second multiplier and having an input coupled to receive counts of impact action undergone by the printer system, the second multiplier multiplying counts in the second accumulator by the indication of job rate and the second constant and providing the product thereof to the decrement input of the first mentioned accumulator.

13. The invention set forth in claim 12, wherein the indication of ribbon length and the indication of job rate are provided at a control panel for the printer system.

14. A method of determining wear of an ink ribbon in an impact printer system comprising the steps of:

storing a value representing a maximum theoretical amount of impacting that can occur before the ribbon is worn out;

providing a job rate indication representing the type of printing to be undertaken by the printer system;

storing a value representing the amount of impacting of the ink ribbon as the printer system prints; and applying the stored value representing the amount of impacting to reduce the stored valued representing a maximum theoretical amount at a rate determined by the job rate indication.

15. The invention set forth in claim 14, further including the step of changing the job rate indication each time the type of printing to be undertaken by the printer system changes without changing the ink ribbon in the printer system.

16. The invention set forth in claim 14, wherein the step of applying the stored value representing the amount of impacting comprises the steps of providing a constant, multiplying the stored value representing the amount of impacting by the job rate indication and the constant to obtain a product, and applying the product to reduce the stored value representing a maximum theoretical amount.

* * * * *